US009427117B2

(12) United States Patent
Barclay

(10) Patent No.: US 9,427,117 B2
(45) Date of Patent: Aug. 30, 2016

(54) QUICK DISCONNECT BUILT-IN DISPENSER

(71) Applicant: Keith A. Barclay, Middlesex, NJ (US)

(72) Inventor: Keith A. Barclay, Middlesex, NJ (US)

( * ) Notice: Subject to any disclaimer, the term of this patent is extended or adjusted under 35 U.S.C. 154(b) by 0 days.

(21) Appl. No.: 14/303,993

(22) Filed: Jun. 13, 2014

(65) Prior Publication Data

US 2015/0053721 A1 Feb. 26, 2015

Related U.S. Application Data

(60) Provisional application No. 61/835,361, filed on Jun. 14, 2013.

(51) Int. Cl.
*A47K 5/12* (2006.01)

(52) U.S. Cl.
CPC ..... *A47K 5/1211* (2013.01); *A47K 5/1205* (2013.01); *A47K 2005/1218* (2013.01)

(58) Field of Classification Search
CPC ..... A47K 2005/1218; A47K 5/12; A47K 5/1211; A47K 5/1217; A47K 5/1205
USPC ..... 222/1, 180, 185.1, 321.1, 382, 461.1; 4/628; 137/801
See application file for complete search history.

(56) References Cited

U.S. PATENT DOCUMENTS

| | | | | |
|---|---|---|---|---|
| 5,148,948 | A * | 9/1992 | Granville et al. | 222/173 |
| 5,476,197 | A * | 12/1995 | Lawrence et al. | 222/321.7 |
| 5,632,414 | A * | 5/1997 | Merriweather, Jr. | 222/52 |
| 7,647,653 | B1 | 1/2010 | Catania | |
| 7,815,074 | B2 * | 10/2010 | Ciavarella et al. | 222/153.09 |
| 2005/0121458 | A1 | 6/2005 | Rosiello | |
| 2010/0170588 | A1 * | 7/2010 | Nelson | 137/801 |

* cited by examiner

*Primary Examiner* — Frederick C Nicolas
*Assistant Examiner* — Bob Zadeh
(74) *Attorney, Agent, or Firm* — Lerner, David, Littenberg, Krumholz & Mentlik, LLP

(57) ABSTRACT

A dispensing system is disclosed. The system includes a pump having a pump mechanism, an outlet, and an internal conduit for pumping a material through the conduit and out of the outlet. The pump also has a body portion. The system further includes a mounting mechanism having a base member sized to extend into and through an opening in a surface, the base member being configured to securely engage the surface. The body portion of the pump includes a first structure composed of a material susceptible to magnetic forces, and the mounting mechanism includes a second structure composed of a material susceptible to magnetic forces, the first and second structures adapted to act on each other through a magnetic force, such that the body portion of the pump is removably securable to the mounting mechanism through a magnetic connection. Methods of use are also disclosed.

22 Claims, 4 Drawing Sheets

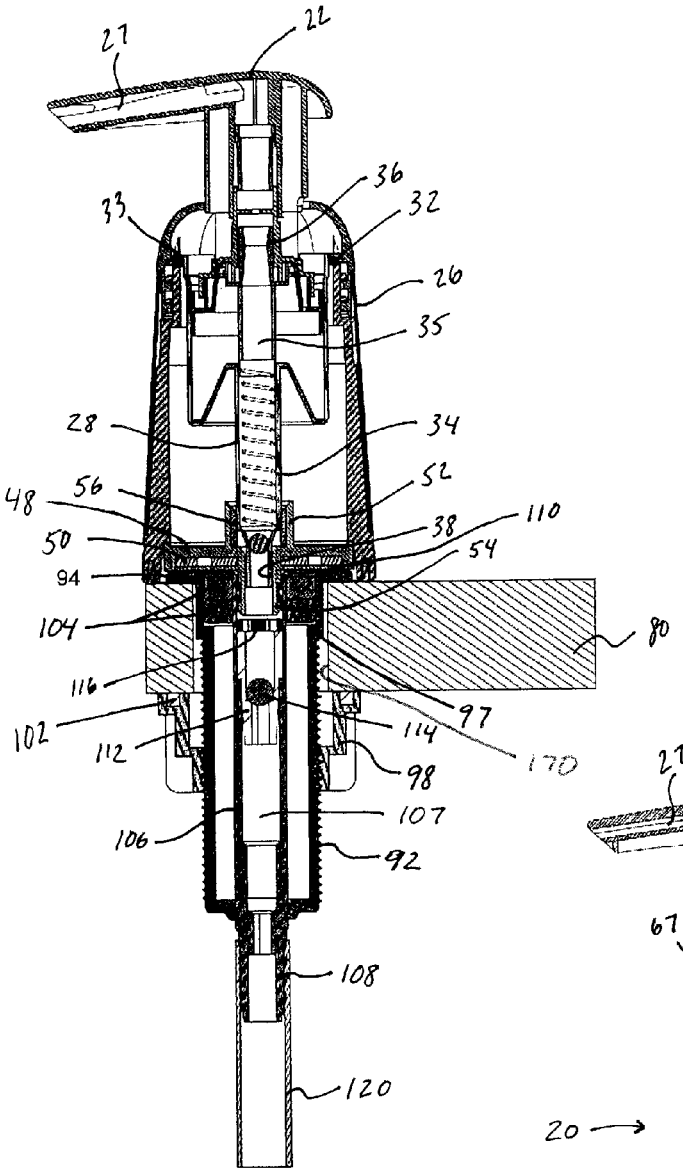
FIG. 4A
FIG. 4B
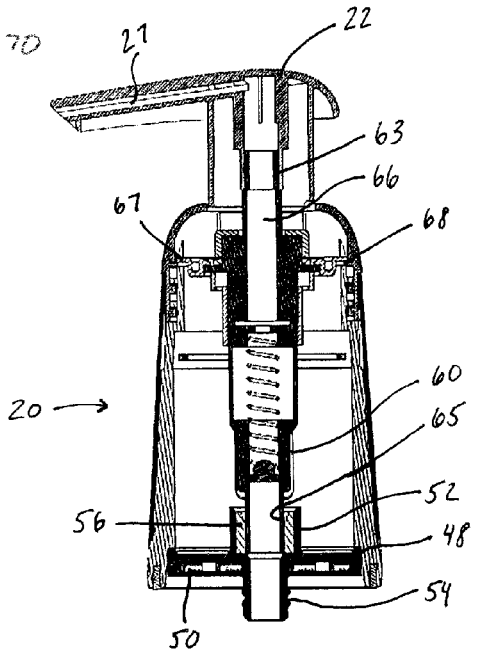

QUICK DISCONNECT BUILT-IN DISPENSER

CROSS-REFERENCE TO RELATED APPLICATIONS

The present application claims the benefit of the filing date of U.S. Provisional Application No. 61/835,361, filed Jun. 14, 2013 and titled "Quick Disconnect Built-In Liquid Dispenser," the disclosure of which is incorporated by reference herein.

This application is also related to: (1) U.S. application Ser. No. 14/183,881, filed Feb. 19, 2014, which claims the benefit of the filing date of U.S. Provisional Application No. 61/767,124, filed Feb. 20, 2013 and titled "Slide-Out Liquid Dispensing Container," and (2) to U.S. Design patent application Ser. No. 29/493,796, filed by the Applicant on the same day as the present application and having a title of "Liquid Dispenser", the disclosures of which are hereby incorporated by reference herein.

BACKGROUND OF THE INVENTION

The present invention relates to a quick-disconnect system for storing and dispensing liquids or other materials such as, for example, soaps or moisturizers.

Existing sink and counter-mounted dispensers are, more or less, quite difficult to disconnect from their counter or other surface-mounted condition. The dispensers generally are surface mounted, but necessitate a messy refilling process as soap or another liquid material must be poured from above the surface and into a container mounted below the surface (e.g., through a small hole formed in the surface sized to hold the dispenser and/or container). During such refilling processes, soap frequently gets everywhere and the procedure is difficult to undertake. Also, these types of dispensers are not easily removable from their surface-mounted conditions, and thus, it makes it difficult to clean the dispenser or around and under the dispenser.

There is therefore a need to provide an improved system for storing and dispensing various substances.

BRIEF SUMMARY OF THE INVENTION

A first aspect of the invention provides a dispensing system, which comprises a pump having a pump mechanism, an outlet, and an internal conduit for pumping a material through the conduit and out of the outlet, the pump having a body portion. The system further includes a mounting mechanism comprising a base member sized to extend into and through an opening in a surface, the base member being configured to securely engage the surface, wherein the body portion of the pump includes a first structure composed of a material susceptible to magnetic forces, and the mounting mechanism includes a second structure composed of a material susceptible to magnetic forces, the first and second structures adapted to act on each other through a magnetic force, such that the body portion of the pump is removably securable to the mounting mechanism through a magnetic connection. In one embodiment of this first aspect, the surface is a countertop next to a sink or a section of a sink. The dispensing system may be operable to dispense various substances such as, for example, liquid or foaming soap, moisturizer, hand sanitizer, or mouthwash.

A second aspect of the invention provides a dispensing system, which comprises a pump having a pump mechanism, an outlet, and an internal conduit for pumping a material through the conduit and out of the outlet, the pump having a body portion. The system further includes a mounting mechanism comprising a base member sized to extend into and through an opening in a surface, the base member being configured to securely engage the surface, wherein the body portion of the pump is removably securable to the mounting mechanism through a magnetic connection. In an embodiment of this second aspect, the magnetic connection utilizes at least one permanent magnet.

A third aspect of the invention includes a method of using a dispensing system comprising the steps of: (1) moving a base member of a mounting mechanism through an opening in a surface and securing the base member relative to the surface; (2) fluidly coupling an internal conduit of the dispensing system with a source of a material; (3) removably attaching a body portion of a pump with the mounting mechanism via a magnetic connection, the pump having a pump mechanism and an outlet; and (4) actuating the pump mechanism to cause the pump to draw the material from the source, through the internal conduit, and out of the outlet of the pump for use. In some embodiments of this third aspect, the surface is a countertop next to a sink or a section of a sink.

BRIEF DESCRIPTION OF THE DRAWINGS

A more complete appreciation of the subject matter of the present invention and of the various advantages thereof can be realized by reference to the following detailed description in which reference is made to the accompanying drawings in which:

FIG. 4A is a cross-sectional view of the dispensing system of FIG. 1 mounted to a surface.

FIG. 4B is a cross-sectional view of a liquid pump, in accordance with an embodiment of the invention.

DETAILED DESCRIPTION

In describing particular embodiments of the present invention, specific terminology will be used for the sake of clarity. However, the invention is not intended to be limited to any specific terms used herein, and it is to be understood that each specific term includes all technical equivalents, which operate in a similar manner to accomplish a similar purpose.

Figure 1:
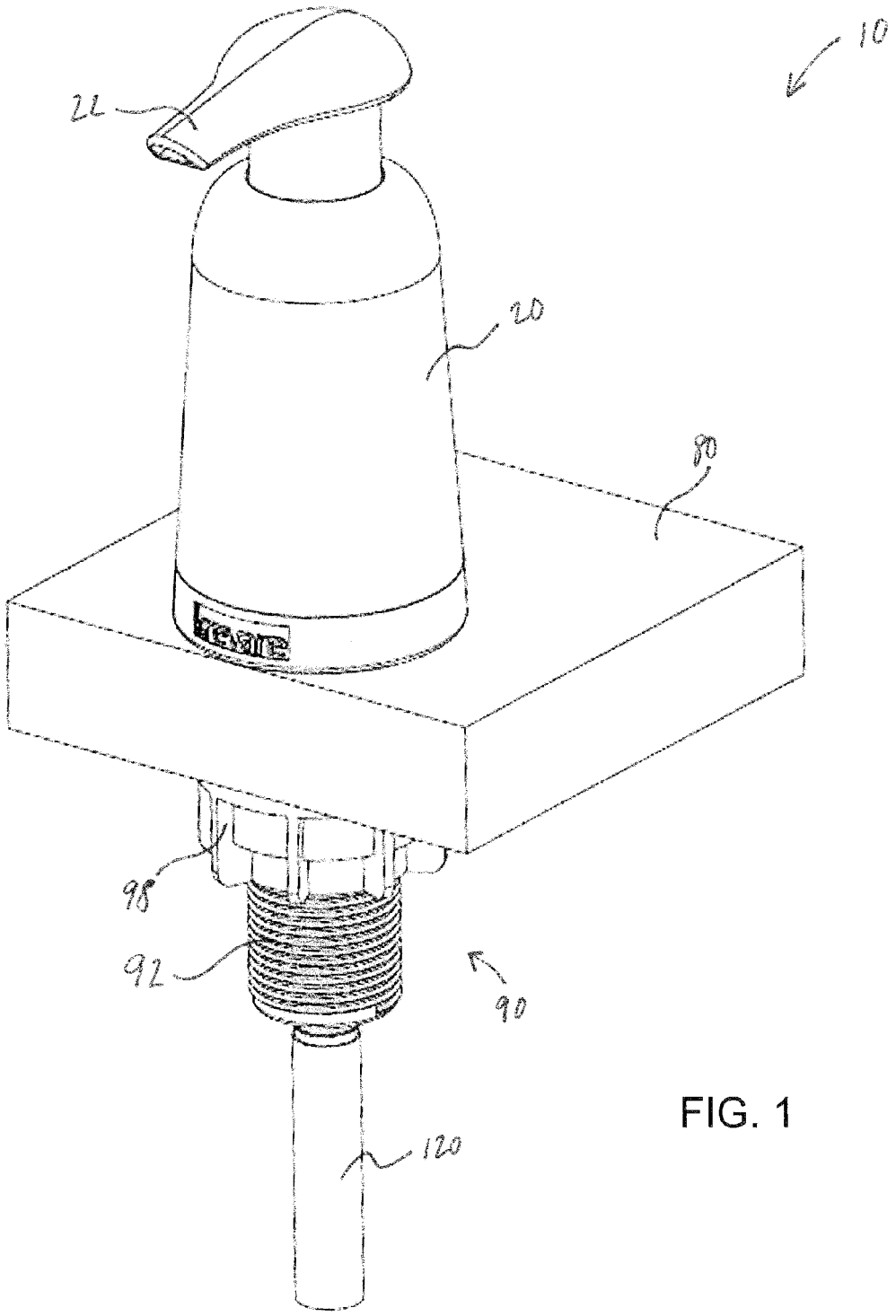
FIG. 1 is a perspective view of a dispensing system in accordance with an embodiment of the invention.

A dispensing system 10 is shown in perspective in FIG. 1. It generally includes a material pump 20 with a pump head 22 having an outlet 160 that is operable to dispense, for example, liquid soap, moisturizer, mouth wash, foam soap, or any other like substance. A mounting system 90 is also included with dispensing system 10 and acts to mount material pump 20 within an opening 170 in a surface 80. In some embodiments, surface 80 is the surface of a countertop (e.g., a marble counter as in a residential setting, or any other countertop), the surface of a sink, a countertop adjacent a sink, or any other like surface. As described below, material pump 20 is easily removable from mounting system 90, and thus surface 80, to provide a quick-disconnect dispensing system 10 for a user.

Figure 3:
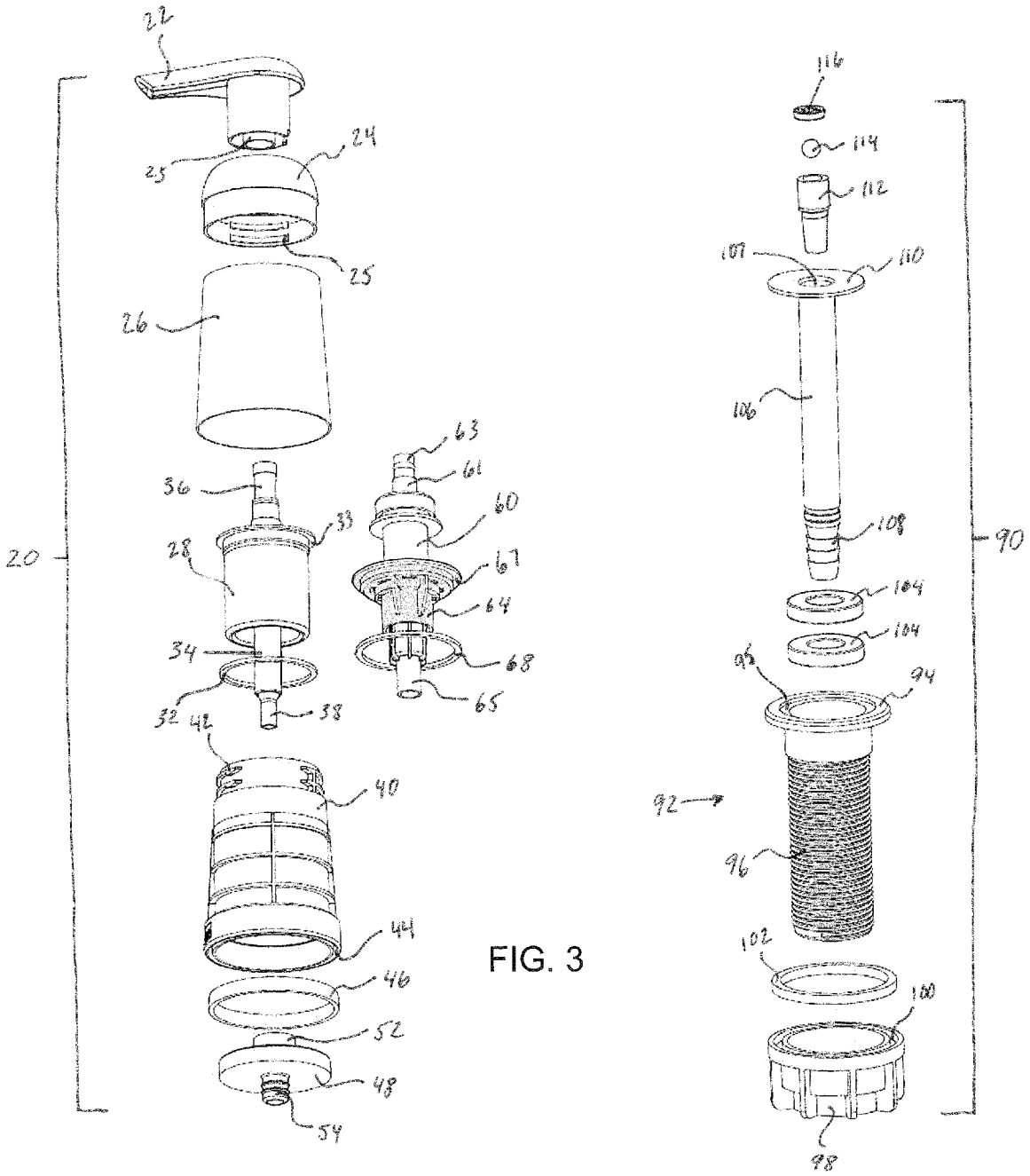
FIG. 3 is an exploded view of the dispensing system of FIG. 1.

Dispensing system 10 is shown in an exploded view in FIG. 3. As depicted therein, material pump 20 includes a pump head 22 having an outlet 160, a pump cap 24, a decorative sleeve 26, a foaming or liquid pump mechanism 28, 60, a pump base 40 having a gasket 46, and a pump seat 48. While the remainder of the components of material pump 20 are described in more detail below, it is worthwhile to first note that foaming and liquid pump mechanisms 28, 60 may be any conventional foaming or liquid pump mechanisms known in the art. In other words, it is contemplated that a wide variety of existing foam and liquid pump mechanisms can be incorporated into dispensing system 10 in the manner described in more detail below. The salient difference between foaming pump mechanism 28 and liquid pump mechanism 60 is, of course, the ability of pump mechanism 28 to generate a foam (e.g., as used for foaming soaps or sanitizers) and the ability of pump mechanism 60 to dispense a liquid (e.g., as used for liquid soaps, moisturizers, or the like).

Pump head 22 includes a cylindrical stem 23 that houses a fluid conduit 27, as shown in FIGS. 3 and 4A-B. In some embodiments, fluid conduit 27 of pump head 22 of foam pump mechanism 28 is larger than fluid conduit 27 of pump head 22 of liquid pump mechanism 60, as exemplified when comparing FIG. 4A to FIG. 4B. Pump head 22 is, in some cases, inserted through an opening in cap 24. Pump cap 24 includes threading 25 for engaging with threading 42 on pump base 40, as described in more detail below.

Decorative sleeve 26 is a cylindrical structure that may be composed of various metallic finishes (e.g., brushed bronze, brushed nickel, silver, etc.) or alternatively it may be composed of a decorative plastic material. Sleeve 26 fits over pump base 40 and is easily removable therefrom so that material pump 20 has a pleasing decorative look. In an alternate embodiment, pump base 40 can be molded to be smooth and decorative without the need for sleeve 26. However, decorative sleeve 26 allows a user to easily interchange sleeves 26 to choose a finish of their choice or otherwise change design aesthetics.

Each pump mechanism 28, 60 includes a pump stem 34, 61 with a fluid conduit 35, 66 therethrough. Fluid conduits 35, 66 are shown best in cross-section in FIGS. 4A-B. Referring to FIGS. 3 and 4A-B, a first end 36, 63 of each pump stem 34, 61 may engage with a portion of pump head 22, in particular its cylindrical stem 23, and a second end 38, 65 of each pump stem 34, 61 may engage with a portion of a pump seat 48. Specifically, in one embodiment pump seat 48 is a hollow disc that has opposing pump stems 52, 54 extending from either side of seat 48. As shown in FIGS. 4A-B, a conduit is formed through pump stems 52, 54 and second end 38, 65 of each pump stem 34, 61 of pump mechanisms 28, 60 may be inserted into the conduit. A seal 56 may also seal the connection.

A spacer 32, 68 is also included with each pump mechanism 28, 60 to assist with engaging mechanisms 28, 60 with pump base 40. In particular, as shown in FIGS. 4A-B, spacers 32, 68 sit on a top perimeter region of pump base 40 and are in contact with respective flanges 33, 67 extending from pump mechanisms 28, 60.

Pump base 40 has a cylindrical body with threading 42 on a top portion thereof for engaging with threading 25 on pump cap 24. Pump base 40 is also sized to allow decorative sleeve 26 to fit over pump base 40's body, and to accept either of pump mechanisms 28, 60 within base 40's interior cavity. A perimetrical recess 44 is also formed in pump base 40 for accepting a gasket 46.

Pump seat 48 is a cylindrical hollow disc with one or more metal rings 50 in its interior, as shown in FIGS. 4A-B. Metal rings 50 can be formed of any material that has magnetic properties including, for example, steel, iron, or nickel. Alternatively, rings 50 may be a permanent or electromagnet instead. As alluded to above, pump seat 48 also includes opposing stems 52, 54 that have a conduit extending therethrough. A seal 56 may also be positioned in stem 52 of pump seat 48 to enhance contact with second end 38, 65 of pump mechanisms 28, 60. In addition, stem 54 can include an over-molded seal as well to enhance contact with other components (e.g., base tube 106, as discussed below). In one embodiment, pump seat 48 may be sonic welded to an interior of pump base 40, as shown in FIGS. 4A-B, such that pump stem 52 extends into the interior of base 40 and pump stem 54 extends outwards out of base 40. This is shown, for example, in FIG. 4B.

Referring back to FIG. 3, mounting system 90 is also shown in an exploded view. Mounting system 90 includes a base tube 106, a threaded base 92, and a nut 98. Base tube 106 includes a fluid conduit 107 therethrough, a barbed end 108, and a flanged portion 110 that is sized so as to fit within a portion of threaded base 92, in particular its circumferential groove 95. In one embodiment, flanged portion 110 is sonic welded or otherwise securely affixed to threaded base 92 along its circumferential groove 95 with the remainder of base tube 106 extending into an interior cavity of threaded base 92.

Threaded base 92 includes a hollow threaded body portion 96 and a flanged section 94. A top internal cavity is also formed in threaded base 92 to securely hold one or more magnets 104. In particular, as shown in FIG. 4A, a lip 97 is formed in the interior of threaded base 92, such that lip 97 may engage with a section of magnets 104 and retain magnets 104 in an upper portion of base 92's internal cavity. Then, flanged portion 110 of base tube 106 may be sonic welded or otherwise secured to groove 95 of base 92 to secure magnets 104 in base 92 via lip 97 and flanged portion 110.

Nut 98 is an internally threaded cylindrical structure adapted to engage with threaded portion 96 of threaded base 92. It also includes a circumferential groove 100 configured to receive a gasket 102, and several surface features (e.g., projections) making it easier for a user to rotate nut 98.

Referring to FIG. 3, mounting system 90 also optionally includes a valve. In one embodiment, the valve is a ball valve having a check valve insert 112, a ball 114, and a cover 116. Cover 116 may be perforated or otherwise have a small opening(s). Check valve insert 112 can be inserted into conduit 107 of base tube 106, ball 114 may be positioned inside of check valve insert 112, and cover 116 may be utilized to retain ball 114 in check valve insert 112.

The operation and assembly of dispensing system 10 will now be described. To assemble material pump 20, a user may simply insert either pump mechanism 28, 60 into the interior of pump base 40 so that second end 38, 65 of the respective pump mechanism 28, 60 is inserted into pump stem 52 of seat 48 and sealed via seal 56. Also, flanges 33, 67 of mechanisms 28, 60 may rest upon spacers 32, 68, which in turn are positioned on the top circumferential section of pump base 40. With pump seat 48 sonic welded to the bottom of pump base 40, the respective pump mechanism 28, 60 may thereby be retained in pump base 40.

Particularly with reference to liquid pump mechanism 60, it may also include a part allowing it to fit within the same pump base 40 as foaming pump mechanism 28. Specifically, in one embodiment, liquid pump mechanism 60 includes a pump fixer 64 arranged about pump stem 61 of liquid pump mechanism 60. Pump fixer 64 includes the above-described flange 67, which allows liquid pump mechanism 60 to rest upon the top of pump base 40. As such, even though portions of liquid pump mechanism 60 are smaller than other like portions of foaming pump mechanism 28, pump fixer 64 may be used to adapt liquid pump mechanism 60 so that it can be used with the same pump base 40. In an alternative embodiment, the size of pump base 40 may simply be altered to fit the sizing of liquid pump mechanism 60 without pump fixer 64.

With the respective pump mechanism 28, 60 secured to pump base 40, decorative sleeve 26 may then be slid over pump base 40 to cover a major portion of its body. This provides good aesthetics for material pump 20 (e.g., a brushed bronze or nickel look, etc.) Then, pump cap 24 may be screwed to pump base by way of the threading 25 on pump cap 24 and the threading 42 on pump base 40. Lastly, pump head 22 can be engaged with second end 36, 63 of the respective pump mechanism 28, 60 via its cylindrical stem 23, and gasket 46 can be press fit or otherwise secured into recess 44 in pump base 40. In this assembled condition, material pump 20 is ready for engagement with mounting system 90.

Figure 2A:
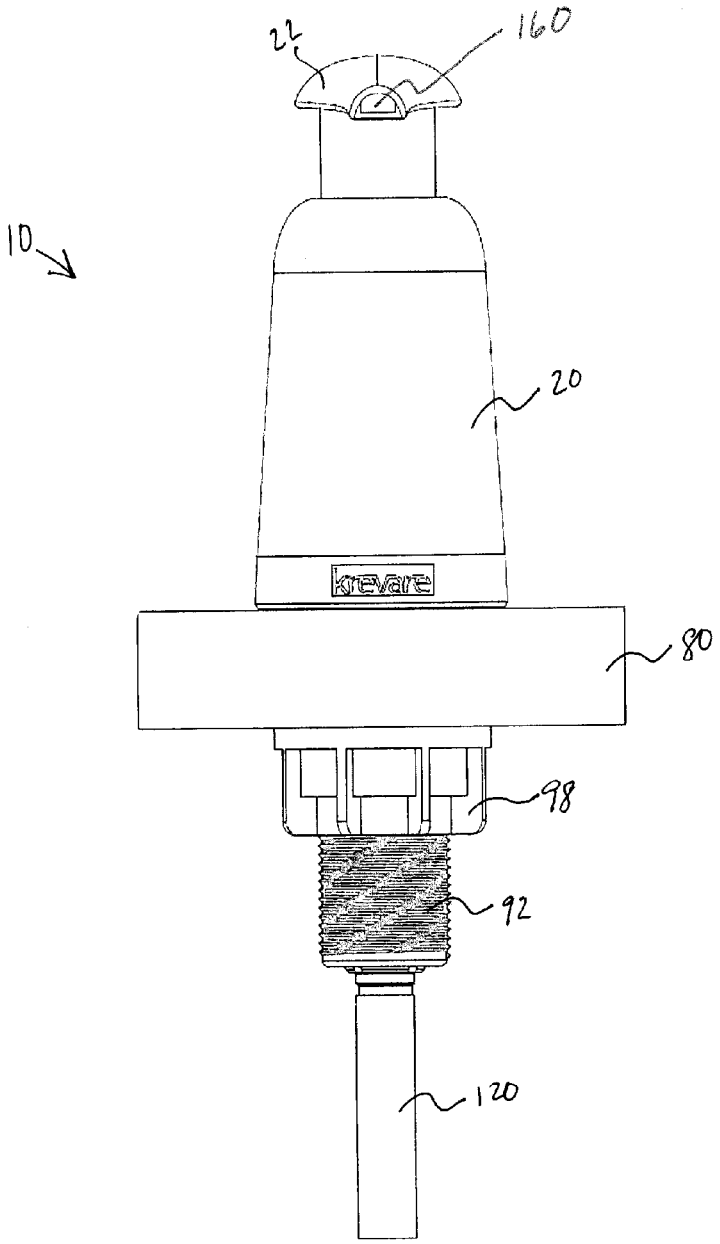
FIG. 2A is a front view of the system of FIG. 1.
Figure 2B:
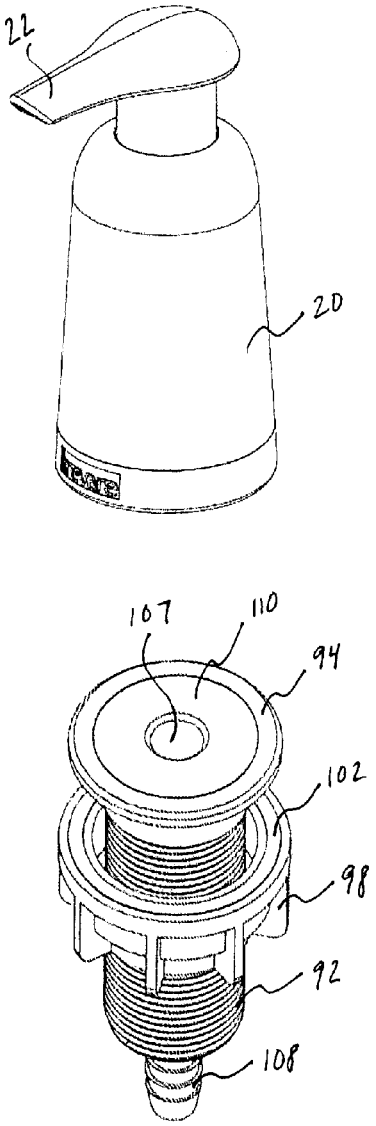
FIG. 2B is a partially-exploded view of the dispensing system of FIG. 1.

Mounting system 90 may be assembled by first inserting check valve insert 112, ball 114, and cover 116 into base tube 106, and then sonic welding or otherwise securing base tube 106 (in particular its flanged portion 110) to threaded base 92. As shown in FIGS. 4A-B, this results in magnets 104 being positioned within threaded base 92 and retained by way of lip 97 and flanged portion 110 of base tube 106. In such a condition, barbed section 108 of base tube 106 may extend out of threaded base 92. Threaded portion 96 of base 92 may then be inserted through an opening 170 in surface 80 and slid through opening 170 until flange 94 of threaded base 92 rests on a top portion of surface 80 above opening 170. In this condition, threaded portion 96 of base 92 can extend through opening 170 and below surface 80 by some predetermined distance. Subsequently, gasket 102 is inserted into groove 100 of nut 98, and nut 98 is screwed onto threaded portion 96 of base 92 until it is in tight contact with a bottom section of surface 80. This causes an opposing action to occur between nut 98 and flange 94 of base 92 to securely retain mounting system 90 within opening 170 in surface 80, as shown in FIG. 2A. And, with gasket 102 arranged in groove 100 of nut 98, as depicted in FIG. 2B, a tight seal is formed at a bottom section of surface 80 so that no water or other substance can accidentally enter the internal components of mounting system 90 beyond gasket 102. Gasket 102 also provides dampening/friction to prevent nut 98 from loosening with use. Likewise, gasket 46 of material pump 20 creates a seal at a top section of surface 80 and/or provides a friction effect. With mounting system 90 securely retained in opening 170 in surface 80, magnets 104 are positioned near an upper part of opening 170 in surface 80 so that material pump 20 can be easily engaged with mounting system 90. The position of magnets 104 is shown best in FIG. 4A.

To engage material pump 20 with mounting system 90, the user simply positions a bottom of pump 20, particularly its pump seat 48 with a metal ring(s) 50, near and around flange 94 of threaded base 92 and a magnetic force between metal ring(s) 50 and magnets 104 causes material pump 20 to snap into contact with mounting system 90. If the user desires to remove or alter the position of material pump 20, he/she can simply pull material pump 20 out of engagement with mounting system 90 so that magnets 104 no longer act on metal ring(s) 50, or the user can rotate material pump 20 while it is engaged with mounting system 90 so that pump 20 is situated in the correct/desirable position.

With material pump 20 engaged to mounting system 90, the user can actuate pump head 22 and cause either foam or liquid (depending on whether foam or liquid pump mechanism 28, 60 is used) to travel out of outlet 160 of head 22 for use. Indeed, barbed section 108 of base tube 106, as shown in FIG. 4A, can be connected with vinyl or other material tubing 120, which in turn is associated with a container of foaming or liquid soap, moisturizer, or another such substance. Such a container, while not depicted in the figures, may be the container shown and described in detail in Applicant's U.S. patent application Ser. No. 14/183,881 ("the '881 Application"), which is incorporated by referenced herein in its entirety above. The container of the '881 Application is positioned under the countertop surface 80 (e.g., within a cabinet under the countertop) and is easy to use and refill. Combined with the present dispensing system 10, the user is therefore provided with a comprehensive system for containing soap or another material (e.g., in the container of the '881 Application or otherwise) and dispensing the soap or other material via dispensing system 10.

During pumping of a liquid or foam through material pump 20, a user actuates pump head 22 by pushing it downwards, which in one embodiment causes ball 114 of valve insert 112 to move into an open position. A fluid material can then, for example, travel through conduit 107 of base tube 106, into valve insert 112, past ball 114, and through cover 116 into the remainder of material pump 20's mechanisms. The liquid material may subsequently travel through the conduit of pump seat 48's stems 52, 54 and into either foaming or liquid pump mechanism 28, 60. Stem 54 may seal with conduit 107 of base tube 106 by way of its over-molded seal to provide an air-tight connection. In some embodiments, foaming and liquid pump mechanisms 28, 60 may also include their own ball valve, as shown in FIGS. 4A-B, which restricts passage of fluid in one direction. Indeed, once the actuation of pump head 22 is stopped, ball 114 of valve insert 112 (and optionally the ball valve of pump mechanisms 28, 60) may move back into their closed positions to stop liquid from travelling completely out of dispensing system 10 and/or tubing 120 and back into the container, for example the container of the '881 Application. This decreases the amount of pumps needed to expel a substance from pump head 22 during the next use by the user as the above-discussed fluid material is retained in tubing 120 and in portions of dispensing system 10 for re-use.

After movement of the fluid material beyond the ball valves discussed above, the material travels into the respective pump mechanism 28, 60's conduit 35, 66 and then into and out of conduit 27 and outlet 160 extending through pump head 22. If foaming pump mechanism 28 is used, during the foregoing process the fluid material will be converted to foam to be expressed out of pump head 22 and to the user. Such foaming components are available in existing foaming pump mechanisms 28 known in the art. If liquid pump mechanism 60 is used, the fluid material will be expressed out of pump head 22 and to the user as a liquid. The user can then wash his/her hands, apply moisturizer, use mouthwash, etc.

In one embodiment, a user may purchase both pump mechanisms 28, 60 and easily interchange them by disconnecting one from mounting system 90 and connecting the other. This could be done if a user wants to switch from a liquid to a foaming soap, for instance. Indeed, as disconnecting a particular material pump 20 only requires pulling on the pump 20 to cause disengagement of magnets 104 and metal ring(s) 50, this is a relatively easy task.

Further, due to the simple magnetic connection described above, a user can accomplish a number of other tasks. The user can easily remove material pump 20 from engagement with mounting system 90 and clean the countertop surface 80 adjacent flange 94 of base 92, and the user can simultaneously clean material pump 20 itself in the sink, if desired. Also, the user can easily remove material pump 20 and substitute in a different decorative sleeve 26 to change the look of pump 20 on occasion. As decorative sleeve 26 is easily removable from pump base 40, this is also an easy task. Put simply, the improved magnetic connection described above allows for a variety of easy tasks to be completed, and it provides for a clean look for dispensing system 10 on surface 80.

Suitable materials for magnets 104 may be neodymium or any other permanent magnetic material. Metal ring(s) 50 can be formed of steel or any other suitable metal or other magnetic material, which is capable of interacting efficiently with magnets 104 to engage material pump 20 with mounting system 90.

Although the invention is described herein with reference to certain structures, others could be employed, of course. For example, although permanent magnets 104 are used in dispensing system 10, it is equally contemplated that a small electromagnet may be utilized. It is also contemplated that while ring(s) 50 is described as being composed of metal, another magnet having an attraction opposite to magnets 104 might be utilized instead. Alternatively, ring(s) 50 and magnets 104 may be switched, such that ring(s) 50 is positioned in mounting system 90 and magnet 104 is positioned in material pump 20. Other suitable connection structures besides a magnetic connection could also be employed such as, for example, a press-fit connection or a bayoneted connection allowing a user to twist material pump 20 into engagement with mounting system 90.

In addition, while surface 80 has been primarily referenced above as a countertop in a residential setting, it could be any surface. For example, surface 80 could be a metal sink surface that accepts systems like dispensing system 10, it could be a countertop surface in a commercial environment, a countertop next to a sink, or any other surface.

And, although dispensing system 10 has been described for use with the container of the '881 Application, any other conventional container could be used. Further, while dispensing system 10 is described as being a manual system, it is equally contemplated that it may be an electronic system. Thus, manual pump mechanisms 28, 60 may be substituted for electronic systems for pumping a liquid or foam material through dispensing system 10 and out of pump head 22. Such an electronic system could make it easier for a user to retrieve foam and/or liquid soap, for example, or could have further applications in the commercial space.

As another example, pump head 24 can, instead of having threading 25, include a twist-lock or other connection feature to engage with a like twist-lock or other connection feature on pump base 40. Thus, other connection mechanisms are contemplated.

Although a certain order of steps is also set forth above for the assembly and/or use of dispensing system 10, it should be recognized that the steps need not be performed in the specified order and can be rearranged as understood by one of skill in the art.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A dispensing system comprising:

a pump having a pump mechanism, an outlet, and a first conduit for pumping a material through the first conduit and out of the outlet, the pump having a body portion; and a mounting mechanism comprising a base member sized to extend into and through an opening in a surface, the base member being configured to securely engage the surface, wherein the body portion of the pump includes a first coupler composed of a material susceptible to magnetic forces, and the mounting mechanism includes a second coupler composed of a material susceptible to magnetic forces, the first coupler and the second coupler adapted to act on each other through a magnetic force, such that the body portion of the pump is removably securable to the mounting mechanism through a magnetic connection, and wherein the second coupler is sized to fit within the opening in the surface and the first coupler is positionable adjacent the opening so as to act on the second coupler and establish the magnetic connection.

2. A dispensing system as claimed in claim 1, wherein the first coupler and the second coupler are a selected from the group consisting of a metal or metal-alloy material and a magnet, a magnet and a magnet, and a magnet and a metal or metal-alloy material, respectively.

3. A dispensing system as claimed in claim 1, wherein the base member includes a flange having a dimension that is greater than a dimension of the opening in the surface so that the flange cannot travel through the opening in the surface.

4. A dispensing system as claimed in claim 3, wherein the base member includes a threaded shaft sized to extend through the opening in the surface, and the dispensing system further comprises a nut with internal threading that is threadable onto the threaded shaft of the base member.

5. A dispensing system as claimed in claim 1, wherein the surface is a countertop next to a sink or a section of a sink.

6. A dispensing system as claimed in claim 1, wherein the body portion of the pump is sized to rest on the surface, such that the pump mechanism is above the surface entirely outside of the opening.

7. A dispensing mechanism as claimed in claim 1, wherein the base member includes an internal cavity housing the second coupler adjacent a first end portion of the base member, in a fixed position relative to the base member, and the base member includes a flange sized to rest on the surface and position the second coupler adjacent the surface.

8. A dispensing system as claimed in claim 7, wherein the internal cavity in the base member includes a lip, and the second coupler is adapted to rest on the lip.

9. A dispensing system as claimed in claim 8, wherein the dispensing system includes one or more valves adapted to prevent backflow of the material after a pumping operation, and the second coupler is a ring.

10. A dispensing system comprising:

a pump having a pump mechanism, an outlet, and a first conduit for pumping a material through the first conduit and out of the outlet, the pump having a body portion; and a mounting mechanism comprising a base member sized to extend into and through an opening in a surface, the base member being configured to securely engage the surface, wherein the body portion of the pump is removably securable to the mounting mechanism through a magnetic connection, and wherein the base member includes a second conduit positioned within the base member, the first conduit and the second conduits being removably attachable to each other, such that the first conduit and the second conduit are fluidly connected when the body portion of the pump is secured to the mounting mechanism through the magnetic connection, and fluidly disconnected when the body portion of the pump is removed from magnetic engagement with the mounting mechanism.

11. A dispensing system as claimed in claim 10, wherein the pump mechanism is a foaming pump mechanism adapted to expel a foam material out of the outlet of the pump, or the pumping mechanism is a liquid pump mechanism adapted to expel a liquid material out of the outlet.

12. A dispensing system as claimed in claim 10, wherein a part of the magnetic connection is a ring surrounding the second conduit.

13. A dispensing system as claimed in claim 10, wherein the base member includes a flange having a dimension that is greater than a dimension of the opening in the surface so that the flange cannot travel through the opening in the surface.

14. A dispensing system as claimed in claim 13, wherein the base member includes a threaded shaft sized to extend through the opening in the surface, and the dispensing system further comprises a nut with internal threading that is threadable onto the threaded shaft of the base member.

15. A dispensing system as claimed in claim 10, wherein the surface is a countertop next to a sink or a section of a sink.

16. A dispensing system as claimed in claim 10, wherein the base member includes an internal cavity housing a first coupler susceptible to magnetic forces, the internal cavity positioning the first coupler adjacent a first end portion of the base member, and the body portion of the pump includes a second coupler susceptible to magnetic forces, the first coupler and the second coupler adapted to act on each other through a magnetic force, such that the body portion of the pump is removably securable to the mounting mechanism through a magnetic connection.

17. A dispensing system as claimed in claim 16, wherein the first coupler and the second coupler are a selected from the group consisting of a metal or metal-alloy material and a magnet, a magnet and a magnet, and a magnet and a metal or metal-alloy material, respectively.

18. A dispensing system as claimed in claim 10, wherein the pump has a stem extending from the body portion through which the first conduit extends, the stem extending into the second conduit when the body portion of the pump is secured to the mounting mechanism through the magnetic connection.

19. A dispensing system as claimed in claim 10, wherein the pump is at least partially covered with a removable decorative cover.

20. A method of using a dispensing system comprising the steps of:

positioning a base member of a mounting mechanism in an opening in a surface and securing the base member relative to the surface;

fluidly coupling a first conduit of the dispensing system with a source of a material;

removably attaching a body portion of a pump with the mounting mechanism via a magnetic connection, the pump having a pump mechanism and an outlet; and actuating the pump mechanism to cause the pump to draw the material from the source, through the first conduit, and out of the outlet of the pump for use, wherein the body portion of the pump includes a first coupler composed of a material susceptible to magnetic forces, and the base member includes a second coupler composed of a material susceptible to magnetic forces, the second coupler being positioned at a first end portion of the base member, and wherein the method comprises moving the first coupler next to the second coupler so that the first and second couplers act on one another to cause the body portion of the pump to magnetically and removably attach to the mounting mechanism.

21. A method of using a dispensing system as claimed in claim 20, wherein the surface is a countertop next to a sink or a section of a sink.

22. A method of using a dispensing system as claimed in claim 20, further comprising positioning the second coupler within the base member and the opening.

* * * * *